US006884108B2

(12) United States Patent
Saito et al.

(10) Patent No.: US 6,884,108 B2
(45) Date of Patent: Apr. 26, 2005

(54) CONNECTOR FOR FLEXIBLE PRINTED CIRCUIT

(75) Inventors: Yuichi Saito, Tokyo (JP); Kumi Hirose, Utsunomiya (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/455,104

(22) Filed: Jun. 5, 2003

(65) Prior Publication Data

US 2003/0232536 A1 Dec. 18, 2003

(30) Foreign Application Priority Data

Jun. 14, 2002 (JP) ..... 2002-174326

(51) Int. Cl.[7] ..... H01R 12/24

(52) U.S. Cl. ..... 439/495; 439/260; 439/328; 439/62

(58) Field of Search ..... 439/260, 492, 439/495, 496, 67, 77, 329, 331, 467

(56) References Cited

U.S. PATENT DOCUMENTS 5,690,502 A * 11/1997 Mochizuki ..... 439/320
5,904,586 A * 5/1999 Takayasu ..... 439/260
6,533,606 B1 * 3/2003 Yamane ..... 439/495

FOREIGN PATENT DOCUMENTS

| | | |
|---|---|---|
| JP | 10-208810 | 7/1998 |
| JP | 2000-48885 | 2/2000 |
| JP | 3029985 | 4/2000 |

* cited by examiner

*Primary Examiner*—Gary Paumen
*Assistant Examiner*—James R. Harvey
(74) *Attorney, Agent, or Firm*—Collard & Roe, P.C.

(57) ABSTRACT

A connector includes a contact, a housing, and an actuator. The housing holds and fixes the contact. The actuator presses an FPC, an object to be connected, and thereby connects the FPC and the contact. The connector further includes a first member that is fixed to the housing. The housing includes an insertion slot therein the FPC is inserted and thereto an open portion is formed. The first member includes a projection segment that projects toward the open portion of the insertion slot. The projection segment is provided with a chamfered portion on a side facing the open portion of the insertion slot.

5 Claims, 7 Drawing Sheets

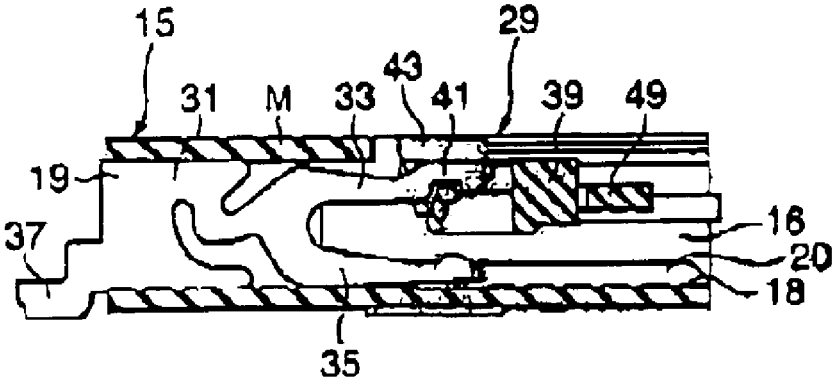
FIG. 2 The Present Invention
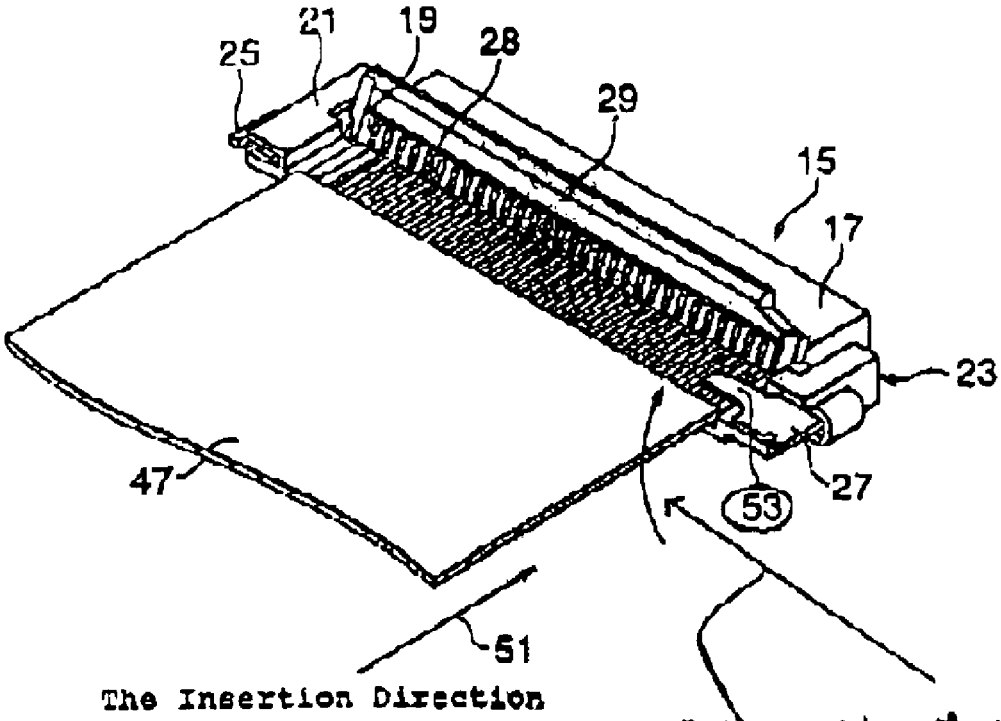
FIG. 3

CONNECTOR FOR FLEXIBLE PRINTED CIRCUIT

This invention claims priority to prior patent application JP 2002-174326, the disclosure of which is incorporated herein by reference.

BACKGROUND OF THE INVENTION

1. Field of the Invention

The present invention relates to a connector for use in a flexible printed circuit that is mounted on a substrate and so on to connect thereto a flexible printed circuit or a flexible flat cable, hereinafter these are together referred to as a flexible printed circuit, FPC.

2. Description of the Related Art

So far, a connector of this kind is disclosed in JP-A-2000-48885, hereinafter referred to as a related art 1. The connector disclosed in the related art 1 in which an insertion direction of a flexible printed circuit (hereinafter referred to as an FPC including a flexible flat cable) is regarded as an anteroposterior direction includes a housing whose upper portion is opened; a plurality of contacts attached from a backside of the housing; and a lever that is supported freely openable from above and presses the FPC against the housing at a predetermined swinging position and to fix thereto. The contact extends from backward of the housing to forward, and includes a contact segment at a tip end thereof a contact point portion that is brought into electrically connection with the FPC is disposed, a lead terminal and an elastic support segment.

The lever includes a projection that presses the FPC against the contacts; a projection that, in a swinging process of the lever, comes into contact with a surface disposed on the housing so as to overrun; and a locking part curved toward a swinging center side of the lever. When the locking part and a tip end of the elastic support segment of the contact are engaged, the lever swings with the tip end of the elastic support segment as a center.

Furthermore, another connector for use in FPC is proposed in JP-A-10-208810 (hereinafter referred to as a related art 2).

A connector according to the related art 2 includes a housing and a contactor, the contactor comprising a prop and thereon a T shape portion made of an upper beam. The upper beam includes a contact beam that has a contact portion on one side with respect to the prop and a rotary beam on the opposite side of the contact beam. Furthermore, means for displacing the rotary beam and thereby displacing a distance with a portion facing the contact beam with a connection portion of the prop and the upper beam as a fulcrum is disposed between the rotary beam and a portion facing the rotary beam.

Still furthermore, also in Japanese Patent No. 3029985 (hereinafter referred to as a related art 3) a connector for FPC is disclosed. In the connector for use in the FPC according to the related art 3, at a slot portion of a housing, a plurality of contactors are disposed. The FPC disposed on contact portions of the contactors is provided with a swing support portion on a side opposite to the contact portions. A cap-like pressurization member is supported freely swinging by the swing support portion between a predetermined position in proximity to the contactors and an open position separated from the predetermined position. The pressurization member includes a pressurization portion that compresses the FPC disposed on the contact portions against the contact portions, when the pressurization member is swung up to the predetermined position. At a slot portion of the housing, the housing is provided with a holding metal part having a restraint wing and a fixing portion on both end portions of at least the slot portion in an arrangement direction of the contactors. The restraint wing is positioned so as to come close to or come into contact with a top surface of the FPC. The fixing portion is soldered to a corresponding portion of a printed circuit board.

However, in the connector according to the related art 1, a problem exists in that, since a direction in which the lever presses the FPC against the contact portion swings and is the same with that in which the FPC is flapped, when the FPC is flapped, the lever presses a contact point of the FPC against the contact to be opened, and to make a contact failure and so on result.

Furthermore, in the FPC connector according to the related art 2, a problem exists in that since an operation lever for pressing is disposed on a side opposite to the FPC insertion slot and a wall is disposed also on an upper side of the FPC insertion slot, the FPC insertion slot can be discerned with difficulty, resulting in inserting the FPC with difficulty.

Still furthermore, in the FPC connector according to the related art 3, a problem exists in that because of the wings disposed at both ends, when the FPC is laterally inserted from above, the wing portion and the FPC interfere each other to result in difficult insertion.

SUMMARY OF THE INVENTION

Therefore, it is one object of the invention to provide an FPC connector that is excellent in the workability of the connector and, when connected, the FPC comes off with difficulty.

It is another object of the present invention to provide an FPC connector that allows an FPC to be inserted into an accurate position of the connector and to be held and engaged assuredly.

According to the present invention, there is provided an FPC connector which includes a contact; a housing that holds and fixes the contact; and a pressurization member that pressurizes an object to be connected and thereby connecting the object to be connected and the contact further includes a first member, the housing comprising an insertion slot therein the object to be connected is inserted and thereto an open portion is formed, the first member comprising, on one side of the insertion slot, a projection segment that projects toward the open portion of the insertion slot, a chamfer being formed on a side facing the open portion of the insertion slot of the projection segment.

Furthermore, according to the present invention, there is provided an FPC connector in which in the above FPC connector, the projection segment is formed of a metal segment, and the metal segment includes an extension through a setting portion in a direction opposite to a projection direction of the projection segment, and the projection segment and the extension are opened toward above.

Still furthermore, according to the present invention, there is provided an FPC connector in any one of the above FPC connectors, in which the chamfer formed on the projection segment is an oblique chamfer surface or a round chamfer surface.

BRIEF DESCRIPTION OF THE DRAWINGS

FIG. 2 is a II—II line sectional view of the connector shown in FIG. 1;

FIG. 3 is a perspective view showing the FPC connector according to the first embodiment of the invention;

DESCRIPTION OF THE PREFERRED EMBODIMENTS

In the following, embodiments according to the present invention will be explained with reference to the drawings. In the following explanation, an insertion side along an FPC insertion direction 51 of a connector is called a front side and a side opposite thereto is called a back side.

Figure 1:
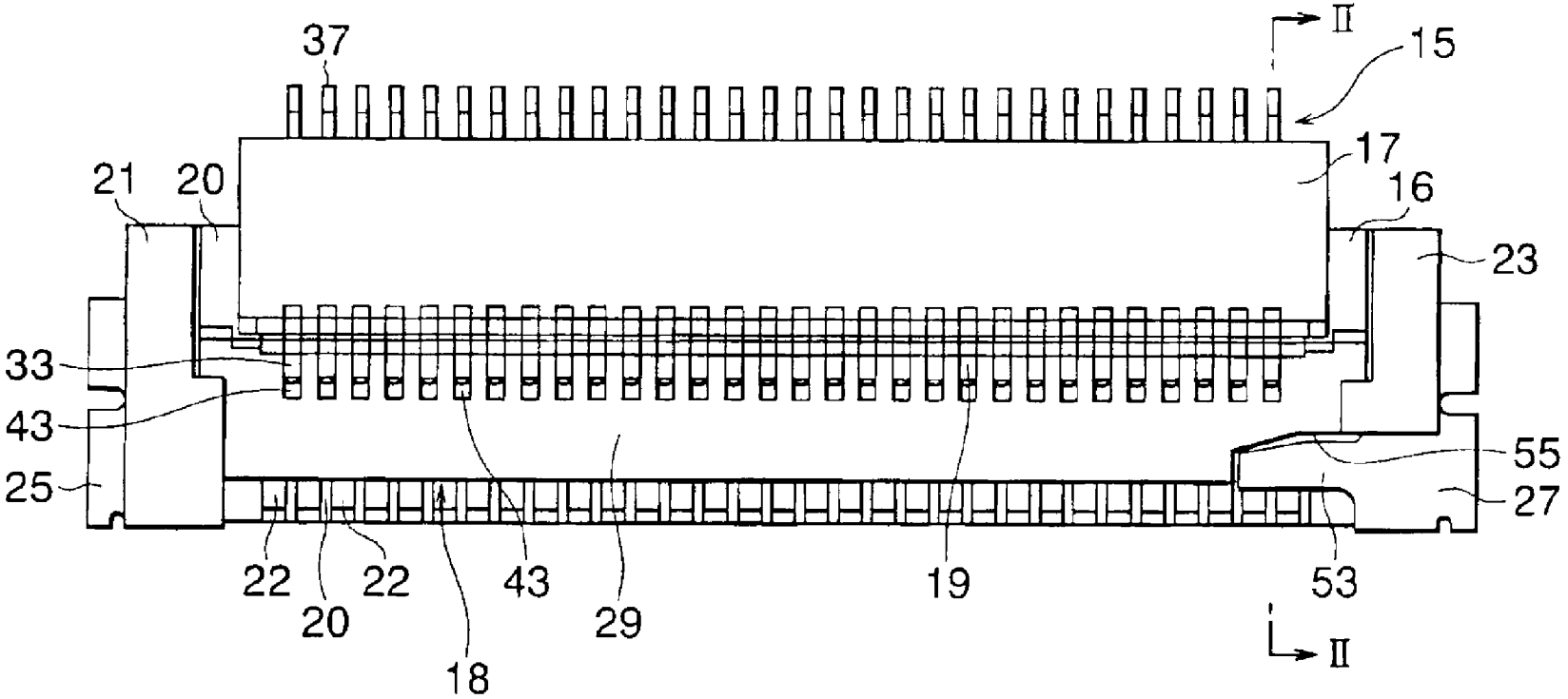
FIG. 1 is a plan view showing an FPC connector according to a first embodiment of the invention.

Referring to FIGS. 1 and 2, an FPC connector 15 according to a first embodiment includes a housing 17 made of a slender box-like insulating material. The housing 17 is provided with a plurality of conductive contacts 19 that is supported and arranged along a width direction. On both sides of the housing 17, through connection portions 16, attachment portions 21, 23 made of a wall portion are disposed. The attachment portions 21, 23 are provided with first and second members 25, 27 respectively made of a metal segment. The housing 17 is provided with an actuator 29, a pressurization member, which by swinging with a back side of the insertion slot 18 of the housing 17 as one axis, pressurizes a flexible printed circuit (hereinafter referred to as an FPC) that can open and close the insertion slot 18. In the invention, the open portion of the insertion slot 18 is a portion 28 that is exposed when the actuator 29 is opened.

The contact 19 is provided with a contact support portion 31 supported inside of the housing 17. The contact support portion 31 is provided with contact contacting portions 33 and 35 that are branched up and down at a forward of the contact support portion 31 and extended forward. At a backward of the contact support portion 31, a terminal portion 37 that is disposed bending stepwise from the contact support portion 31 and protruding outward along a lower surface of the housing 17 is disposed.

As best shown in FIG. 2, the actuator 29 is provided with a square rod-like pressurization portion 39 having a square section on a bottom surface side. Furthermore, the actuator 29 is provided with a fulcrum 41. The fulcrum 41 is disposed so as to engage with a concavity inside of an upper side contact contacting portion 33 of the contact 19. Therefore, the actuator 29 may freely swing with a lower side contact contacting portion 35 covered. Still furthermore, the actuator 29 is provided with a penetrated slender clearance hole 43 for the contact contacting portion 35 of the contact 19 at a position corresponding to the contact 19.

At a bottom portion of the insertion slot of the housing 17, projection portions 22 are disposed arranged in a width direction. The projection portions 22 adjacent to each other form a grove 20 for accommodating a lower portion contact portion 35 of the contact 19.

At both ends of the housing 17, a first member 25 and a second member 27 are disposed. The actuator 29 of a pressurization member is attached freely swinging so as to cover the contact 19.

Fundamental structures of the housing 17, the contact 19, the openable actuator 29 and the contact points disposed to the FPC 47 are similar to that of the related art 1 and 3.

An FPC connector 15 according to the first embodiment of the invention is different from the existing technologies in that the FPC connector 15 includes attachment portions 21 and 23 on both sides of the housing 17 and the attachment portions 21 and 23 include a first member 25 and a second member 27, respectively.

The second member 27 made of a metal segment is provided with a projection segment 53 projected toward inward in a width direction of the FPC connector 15, thereby the FPC is guided in inserting, resulting in easy insertion.

Referring to FIG. 3, the contacts 19 are supported in parallel by the housing 17. At both ends of the housing 17, the first member 25 and the second member 27 are disposed. An actuator 29, a pressurization member, is attached freely swinging so as to cover the contacts 19. The actuator 29 pressurizes down the FPC 47 inserted in a direction shown with an arrow mark 51 to stop, and thereby resulting in connecting with the contacts 19.

Figure 4:
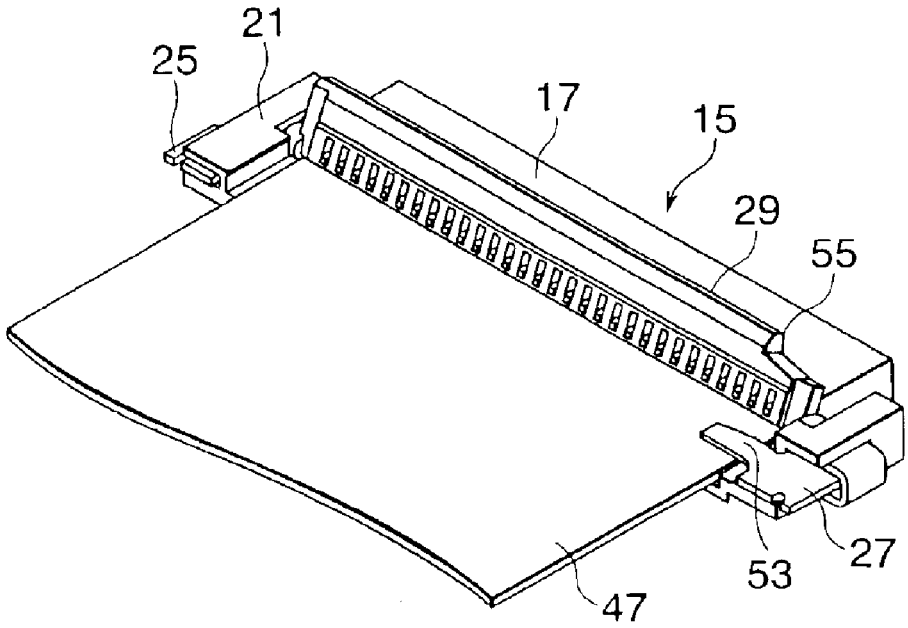
FIG. 4 is a perspective view showing a state where the FPC is inserted from a state shown in FIG. 3 into an FPC insertion slot of a housing.
Figure 8:
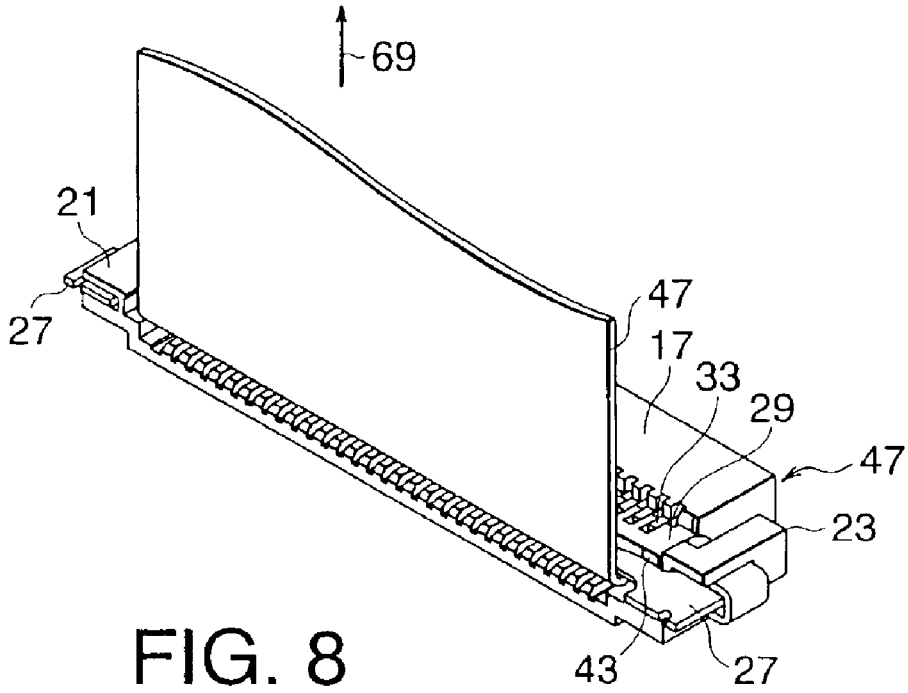
FIG. 8 is a perspective view showing a state when the FPC is pulled upward from a state shown in FIG. 5.

As shown in FIG. 4, in the second member 27 made of a metal segment, the projection segment 53 is formed projecting toward inward in a width direction of the FPC connector 15. The projection segment 53 guids the FPC 47 in inserting and thereby allows easily inserting in the housing. The projection segment can inhibit, as shown in FIG. 8, the FPC 47 from flapping, and thereby inhibiting the FPC 47 from disengaging.

Furthermore, in order that the projection segment 53 of the second member 27 may not be in the way, when the actuator 29 is swung to close the insertion slot 18 followed by pressing down the FPC 47 and thereby the FPC 47 is fixed with the contact portions of the FPC 47 being in contact with the contacts 19 a notch portion 55 is disposed as a clearance portion on a side corresponding to the projection segment 53 of the actuator 29.

Figure 5:
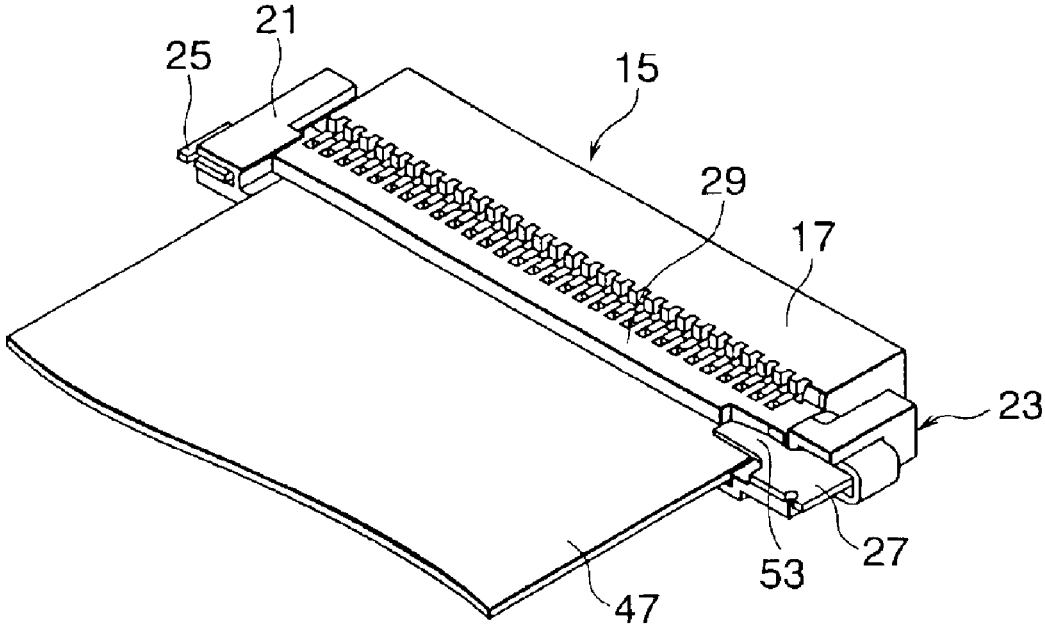
FIG. 5 is a perspective view showing a state where an actuator is swung from a state shown in FIG. 4 to close and thereby fixing the FPC.

As shown in FIG. 5, when the actuator 29 is swung to close, the FPC 47 is fixed in an engaged state.

Figure 6:
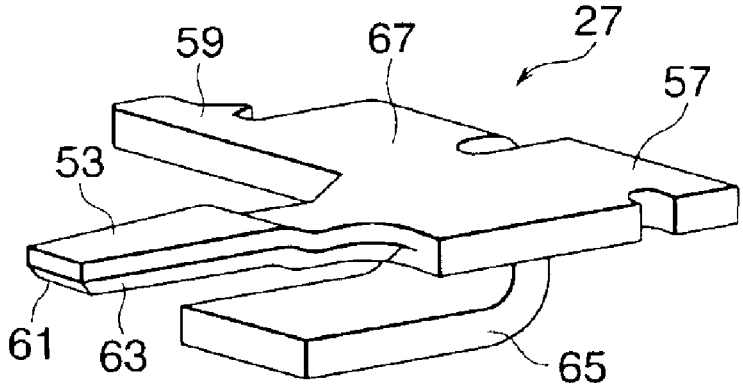
FIG. 6 is a perspective view showing a first member shown in FIG. 3.

Referring to FIG. 6, the second member 27 is provided with an extension 57 made of a tabular plate and an attachment portion 59 extended in one direction from the extension 57. The attachment portion 59 is disposed to attach to the attachment portion 23 of the housing 17 of the FPC connector 15. In a direction that intersects with the attachment portion 59, the projection segment 53 is disposed. At a corner of a lower side of the projection segment 53, on an insertion side from a lateral direction of the FPC 47, by chamfering, a slant surface 61 is chamfered. On an insertion side from a front direction an oblique chamfer surface 63 is formed. In inserting, the FPC 47 and the projection segment 53 can be guided by the slant surface 61 or 63 if interfering with each other and furthermore the FPC 47 can be smoothly aligned to the insertion position.

Furthermore, the second member 27 is provided with a fixing portion 65 that extends from an end side of the extension 57 that faces the projection segment 53 to a side opposite to the projection segment 53, bends downward, further bends so as to direct to a direction the same as the projection segment 53 to form a horseshoe shape, and thereby fixing to a base.

A connection portion 67 of the attachment portion 59 and the extension 57 is a portion that becomes a fulcrum of elastic displacement when the projection segment 53 is flapped by the FPC 47.

Figure 7:
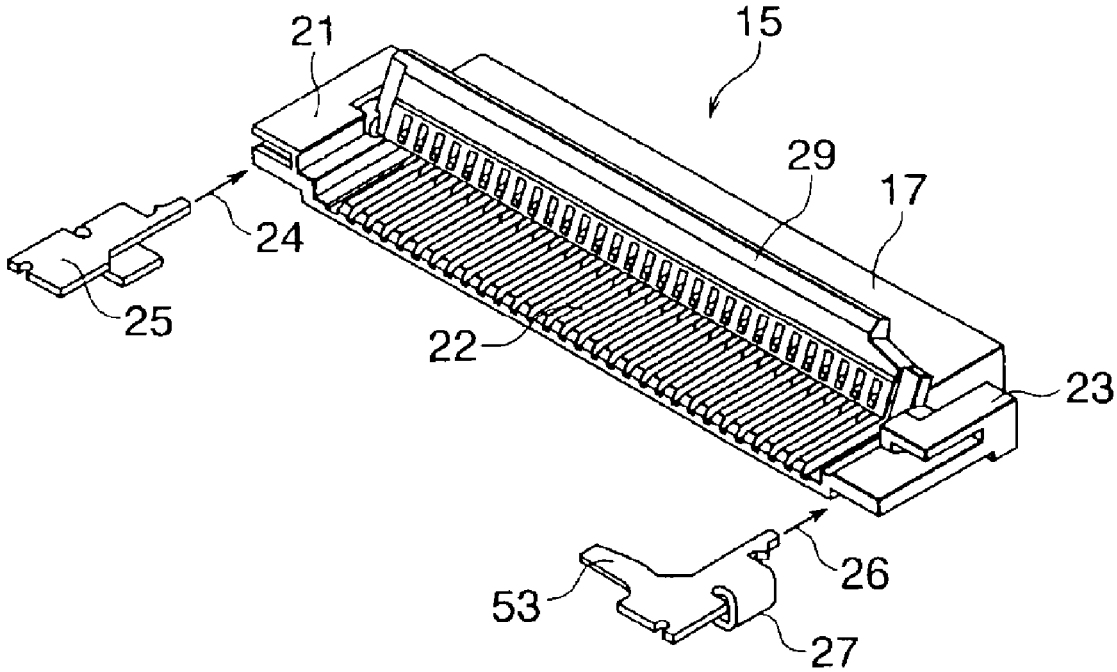
FIG. 7 is a perspective view showing a direction in which first and second members 4 and 5 shown in FIG. 6 are attached to the housing.

As shown in FIG. 7, to the attachment portions 21 and 23, wall portions on both sides, in directions shown with arrow marks 24 and 26, metal segments 25 and 27 are attached, respectively. At that time, the projection segment 53 and the extension 57 are opened upward from the FPC connector 15 and are exposed.

Figure 9:
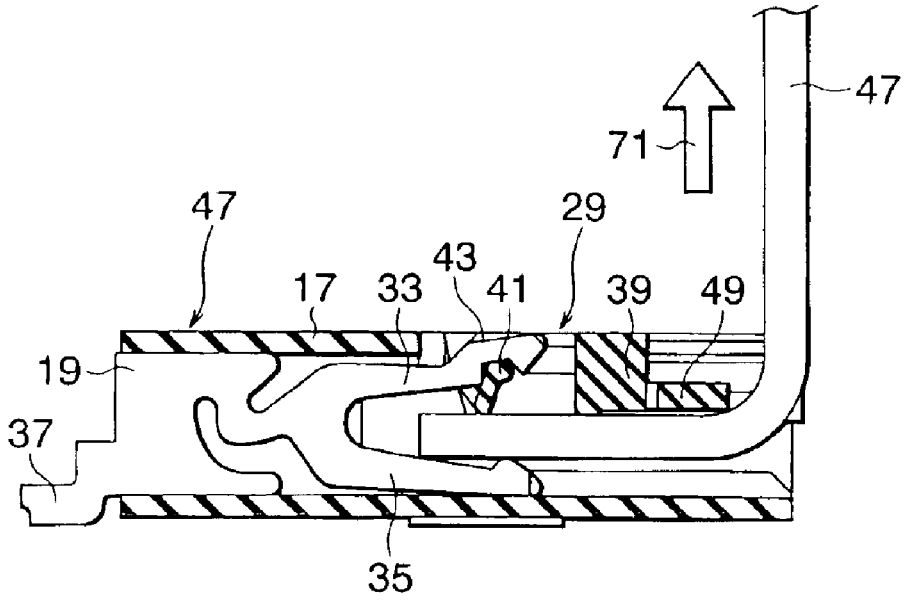
FIG. 9 is a sectional view of FIG. 8 in a position the same as that of the II—II line of FIG. 1.

Referring to FIGS. 8 and 9, the FPC 47 is interposed between the contact contacting portions 33 and 35 of the contact 19 and furthermore the actuator 29 is swung through the fulcrum 41. By this movement, the fulcrum 41 is downwardly biased owing to a restoring force of the elastic deformation of the contact contacting portion 33 of the contact 19 and presses downward the FPC 47 through a pressurization portion 39. Thereby a contact force is obtained between the FPC 47 and the contact contacting portion 35. In the FPC 47, in the drawing, on a back surface side thereof, an exposed portion of a conductor or an electrode is formed so as to come into contact with the contact contacting portions 35.

In FIGS. 8 and 9, arrow marks 69 and 71 show the same directions. When the FPC 47 is flapped in a direction shown with these arrow marks, owing to the projection segment 53 of the second member 27 that is formed projecting toward inside in a width direction of the FPC connector 15, the flapping due to the FPC 47 is inhibited from occurring. In addition to the pressurization portion 39 being kept from moving upward owing to pulling out of the FPC 47, the FPC 47 is inhibited from causing contact failure and disengagement.

Figure 10:
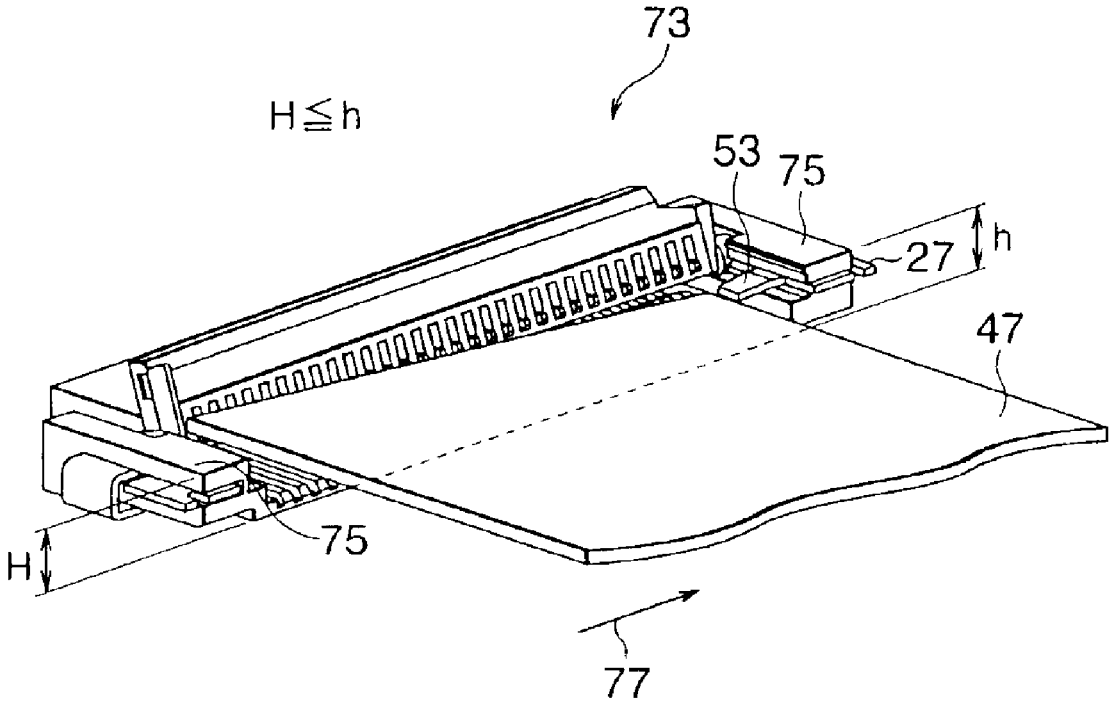
FIG. 10 is a perspective view showing a use state of a FPC connector according to a second embodiment of the invention.
Figure 11:
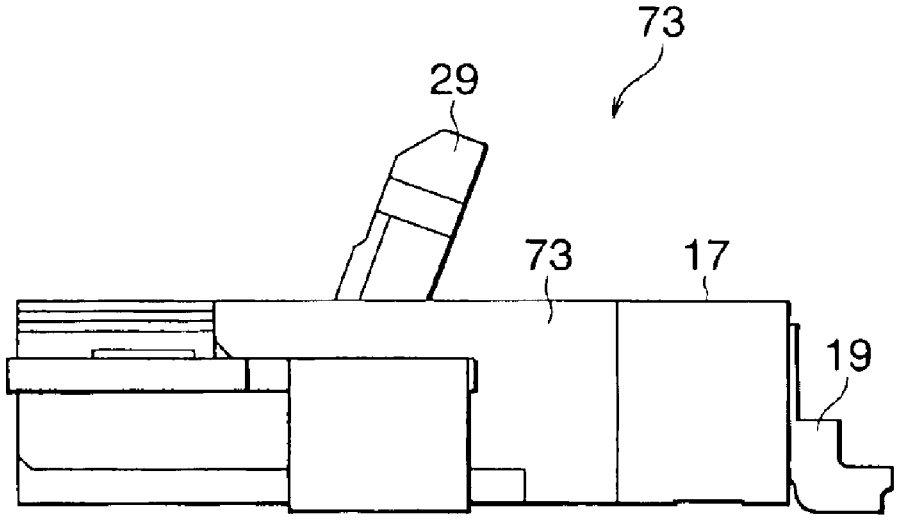
FIG. 11 is a side view of the FPC connector shown in FIG. 10.

As shown in FIGS. 10 and 11, an FPC connector 73 according to a second embodiment has an attachment portion (wall portion) 75 thereto the second member 27 provided with the projection segment 53. The attachment portion is formed with a height h higher than or equal to a height H ($H \leqq h$) of the attachment portion (wall portion) 21 thereto the first member 25 is disposed. In such configuration, since the height of the attachment portion 75 is higher and furthermore the projection portion 53 is disposed, as shown in FIG. 10, even when the FPC 47 is inserted from an oblique lateral direction 77, connection can be established.

Figure 13:
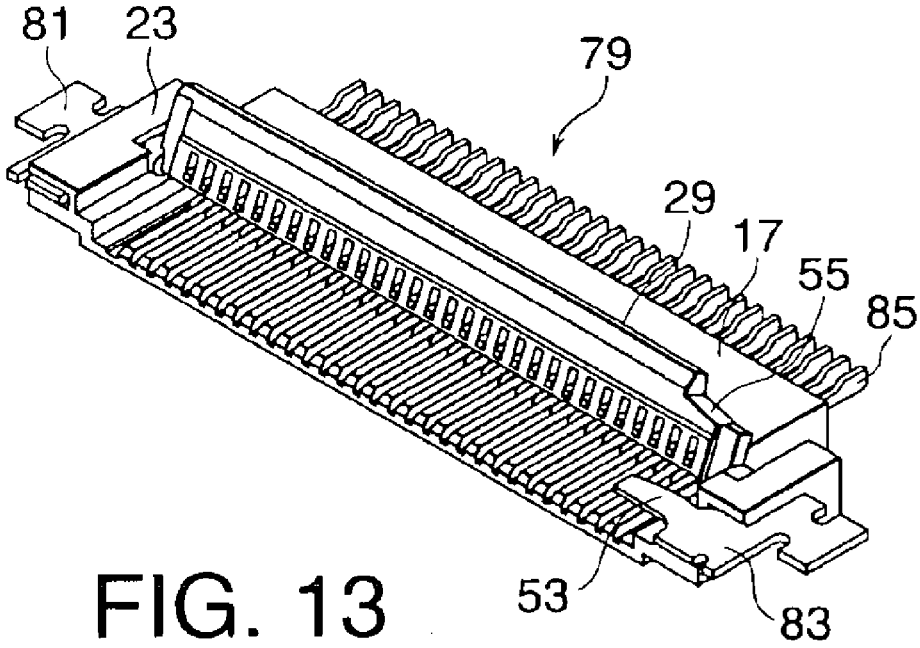
FIG. 13 is a perspective view of the connector having the metal segment shown in FIG. 12.

As shown in FIG. 13, an FPC connector 79 according to a third embodiment has a configuration similar to that according to the first embodiment except for differing in shapes of first and second members 81 and 83 and contacts 85 respectively made of metal segments. In each of the contact 85, a terminal portion for connecting to a base or the like is disposed exposed in the backward of the housing 17.

Figure 12:
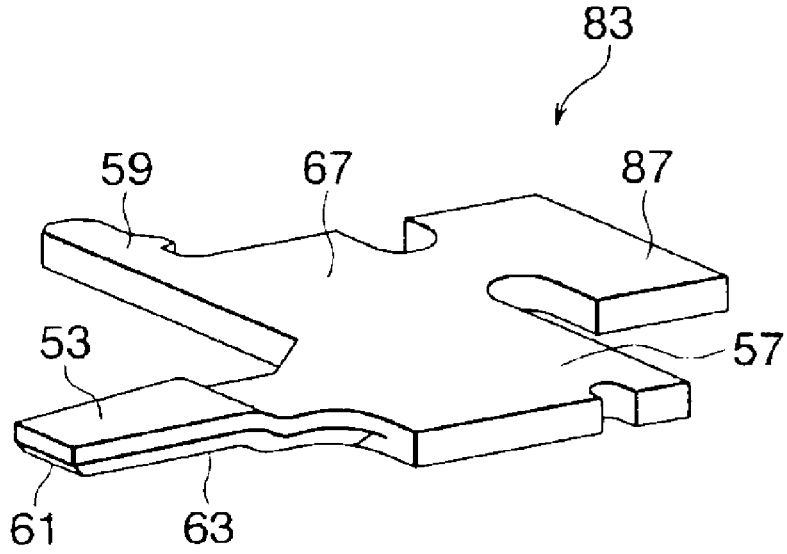
FIG. 12 is a perspective view showing a metal segment provided with a projection segment of the FPC connector according to a third embodiment of the invention.

As shown in FIG. 12, the second member 83 has a configuration similar to the second member 27 shown in FIG. 6 except for a fixing portion 87 extending level on both sides so that a lead wire may be soldered.

That is, the second member 83 includes an extension 57 made of a plane table and an attachment portion 59 extended from the extension 57 in one direction. The attachment portion 59 is disposed so as to attach to the housing of the connector. In a direction that intersects with the attachment portion 59, the projection segment 53 is disposed. At corners of a lower side of the projection segment 53, by chamfering, an oblique chamfer surface 61 is formed on an insertion side from a lateral direction of the FPC 47 and an oblique chamfer surface 63 is formed on an insertion side from a front side. The oblique chamfer surfaces 61 and 63 are disposed to guide the FPC 47. Furthermore, a fixing portion 87 is formed so as to extend from the extension 57 on a side facing the projection segment 53 to a side opposite to the projection segment 53 and to be a level and narrow necked square. The fixing portion 87 is disposed to fix to the substrate or other electronic components, lead wires by soldering or the like.

Furthermore, the first member 81 also has a configuration similar to the first member 25 described in the first and second embodiments except for a shape of the fixing portion being different therefrom.

As mentioned above, in the FPC connectors 15, 73 and 79 according to the first through third embodiments, the projection portion 53 projecting above the FPC 47 is formed in the second members 27, 83. At corners that come into contact with a top surface of the FPC 47 of the projection segment 53, slant surfaces 61 and 63 are formed. Accordingly, in mounting the FPC 47, the FPC 47 and the projection portion 53 are inhibited from interfering with each other, and thereby the FPC 47 is allowed to insert into an accurate position of the FPC connectors 15, 73, and 79. Furthermore, the FPC 47 can be assuredly held and engaged.

In the above-described embodiments according to the invention, although the first members 27, 83 are explained with a metal segment made of a metal, it goes without saying that the first member may be formed with other materials such as resin, or can be formed integrally with the housing.

As mentioned above, according to the invention, a connector in which by disposing a projection segment to a metal segment, the flapping can be inhibited from occurring, and thereby the disengagement of the FPC and destruction of the connector caused by the flapping can be inhibited from occurring can be provided.

Furthermore, in the invention, only one of the metal segments on both sides is provided with the projection segment. Accordingly, the FPC can be inserted from a lateral direction into the FPC insertion slot of the connector, resulting in, despite of the formation of the projection segment, providing a connector capable of improving insertion properties.

Still furthermore, according to the invention, when at a lower portion of the projection segment in a direction therein the FPC is laterally inserted, a slant surface 4*e* is formed, a connector that can be guided by the slant surface even when the FPC and the projection segment interfere each other and can be smoothly fitted to the insertion position can be provided.

Furthermore, according to the invention, an amount of projection to the FPC insertion slot can be made smaller, and the projection segment can be formed longer. Accordingly, since when the projection segment is flapped by the FPC, sufficient elasticity can be given, the projection segment can be inhibited from deforming. As a result, an FPC connector capable of giving sufficient strength even when the connector is made smaller can be provided.

What is claimed is:

1. A connector comprising:

a contact;

a housing for holding and fixing the contact, the housing comprising an insertion slot in which an object to be connected is inserted in an inserting direction of the object and which has an open portion, the object having a flat shape;

a pressurization member for pressurizing the object to be connected and thereby connecting the object to be connected and the contact; and a pair of metal segment members, one of the pairs of the metal segment members containing a projection segment on one side of the insertion slot and chamfered portions on a side facing the open portion of the insertion slot, the projection segment projecting in a direction intersecting the inserting direction of the object so as to face and cover the open portion of the insertion slot, one of the chamfered portions being formed on an insertion side from a lateral direction of the object, and another one being formed on an insertion side from a front side, each chamfered portion being a slant chamfer or a round chamfer.

2. A connector as set forth in claim 1, wherein the projection segment comprises an extension portion of the housing through an attachment portion in a direction opposite to the projection direction of the projection segment, the projection segment and the extension portion being opened toward above.

3. A connector as set forth in claim 1, wherein the object to be connected is a flexible printed circuit or a flexible flat cable.

4. A connector as set forth in claim 1, wherein the contact is provided with a terminal portion for mounting to a substrate.

5. A connector as set forth in claim 1, wherein the contact comprises a pair of contact contacting portions disposed to branch in a plane including a rotation direction of the pressurization member at one end of the contact, one of the pair of the contact contacting portions being in contact with the object to be connected, the other one of the pair of contact contacting portions being engaged so that a fulcrum portion disposed to the pressurization member and the pressurization member is able to rotate with the fulcrum portion as a center.

* * * * *